United States Patent [19]

Vunderink

[11] Patent Number: 4,900,409

[45] Date of Patent: Feb. 13, 1990

[54] MASS GRINDING AND POLISHING OF METAL ARTICLES IN ROTOFINISH EQUIPMENT

[75] Inventor: Ate Vunderink, RN Bussum, Netherlands

[73] Assignee: Metallgesellschaft Aktiengesellschaft, Frankfurt, Fed. Rep. of Germany

[21] Appl. No.: 207,268

[22] Filed: Jun. 15, 1988

[30] Foreign Application Priority Data

Jun. 17, 1987 [NL] Netherlands ..... 8701407

[51] Int. Cl.[4] ..... C25F 3/24; C09K 3/14; B24B 1/00; C09C 1/68

[52] U.S. Cl. ..... 204/129.46; 51/304; 51/306; 51/309; 51/317

[58] Field of Search ..... 204/129.46; 51/309, 51/317, 306, 304, 7

[56] References Cited

U.S. PATENT DOCUMENTS 2,735,231 2/1956 Simjian ..... 51/7
2,735,232 2/1956 Simjian ..... 51/7
3,523,834 8/1970 Hewins ..... 51/317 X
4,451,269 5/1984 Makedonski et al. ..... 51/309 X
4,512,859 4/1985 Inoue ..... 51/317 X

*Primary Examiner*—Donald R. Valentine
*Attorney, Agent, or Firm*—Ladas & Parry

[57] ABSTRACT

Process for grinding and/or polishing metal articles in rotofinish equipment, in which (a) an adjusted quantity of said articles, which have a metal surface roughness that is higher than required for the finish, usually larger than 5 μm in AA (i.e. arithmic average); are introduced to a rotofinish apparatus and rotated for some time with (b) an adequate quantity of chips suitable for grinding and/or polishing the metal articles to be treated and (c) a compound that promotes grinding and/or polishing comprising one or more organic acids, wherein the compound is an organic acid or mixture of organic acids or solutions of organic acids in a concentration suitable for grinding and/or polishing the metal articles, and in that the grinding environment also comprises a finely divided metal or alloy with an oxidation potential greater than zero.

7 Claims, 3 Drawing Sheets

MASS GRINDING AND POLISHING OF METAL ARTICLES IN ROTOFINISH EQUIPMENT

INTRODUCTION

Rotofinish equipment is understood to refer to rotating and or vibrating units such as clock, drum and vibro equipment, spiratrons, centrifugal grinding equipment, etc. This equipment is used for the mass surface treatment of articles of various nature.

These treatments (mainly grinding and polishing) are usually supported by chips and compounds.

The term chips is understood to mean pieces, grains, chunks etc. of materials of the most diverse nature, such as glass, basalt, marble, plastic, ceramics etc. that exert a scouring, grinding, polishing action on the surface to be treated by means of rotation and/or vibration. Bound grinding powders such as alundum, silicon carbide, quarts etc. are often used, bound in the form of porcelain grains, ceramic polyhedrons, plastic cones, balls, etc.

The term compounds is understood to refer to additions (whether or not in the form of solids or liquids) to the rotofinish process that actually boost and/or accelerate the treatments such as grinding and polishing by means of their chemical and/or physicochemical influences on the surface of the material to be treated. Metal articles are understood to be objects such as machine and tool parts, wrenches, decorative objects, etc. that e.g. are made of a metal alloy.

Finely divided powdered material is understood to be a powdered material of which the particles have dimension in the range of a few μm.

STATE OF THE ART

Chemicals (whether or not in solutions) have been used from time immemorial in order to obtain smooth metal surfaces. Numerous chemical compounds are to be found in literature for pickling, etching, burnishing etc. With electrolytical polishing a (whether or not pulsating) direct current is applied simultaneously to a chemical reaction, by which process shiny metal surfaces can be obtained.

In all these methods, a relatively great amount of metal from the articles dissoles into the solution.

A relatively far smaller loss of metal occurs with rotofinish processes. They combine the abrasive action of the chips with the action of a compound of relatively milder effect than the chemicals applied in pickling, etching, burnishing etc.

A rotofinish apparatus that is often applied in surface treatment is the spiratron.

A spiratron is a large kind of bowl with circularly rising bottom that is given a circular and vibrating movement, and thus the chips in the bowl develop a vibrating, rotating motion, thus exerting a abrasing, grinding and polishing working on the metal articles that are to be treated.

In conventional processes, these treatments are highly time-consuming and often last as long as 10–24 h.

Therefore it is essential to shorten the duration of the treatment or to accelerate the vibro grinding process with the aid of a chemical (physical) expedient. A lot of research has been done in this field:

According to Safranek & Miller (Vibratory Finishing with chemical accelerators) bisulphates and bichromates considerably cut the grinding period. According to Semones (U.S. Pat. No. 3,979,858) aqueous solutions of organic acids with a pH of about 1.5 are time-saving. Roesner (U.S. Pat. No. 2,298,418) uses phosphates, Chang (U.S. Pat. No. 3,932,243) advocates phosphate esters as compound for accelerating the grinding/polishing process. The best results were obtained by Michaud (U.S. Pat. No. 4,491,500). Michaud uses oxalic acid with poly phosphate in a oxidating environment (e.g. H202) and attains a 25–80 % cut of the grinding period. Michaud emphasizes that chemical reactions at the metal surface and the oxidating environment result in the forming of a conversion layer that is easily scoured off.

INVENTIVE IDEA

The present invention aims to provide an improved process for grinding and/or polishing metal articles.

In the present case, research was conducted from another angle.

If a metal is exposed to a medium that produces hydrogen in status nascendi at the surface of said metal, then the consequence may be that the hydrogen is resorbed by the metal. This considerably reduces the strength of the metal surface.

Creating this superficial hydrogen hydrogen brittleness contributes towards the reduction of the duration of the grinding process.

The chemical and physical reaction mechanisms involved are extremely complex:

1. Creating the hydrogen brittleness as a function of time is an important parameter; many factors influence the speed with which a surface hydrogen brittleness is established, e.g.:

2. The amplitude and the frequency of the vibrating chips and/or the rotational speed and dimensions of the roto-grinding equipment.

3. The chemical composition of the compound; the concentration, the process temperature etc. are relevant to the development of hydrogen in status nasendi and the resorption thereof.

All these factors, and the nature and composition of the material to be ground, influence the extent of hydrogen brittleness.

Boundary phenomena between chips, medium and metal surface, such as micro elements, contact potentials, redox potentials, overvoltages, local elastic and plastic deformations in the surface, etc., are quite relevant. The term "contact potential" referring to the potential difference (potential jump) which results from the physical contact between the metal powder and the surface of the metal articles to be ground and/or polished.

DESCRIPTION OF THE INVENTION

Starting from the inventive idea, a number of tests were conducted.

Equipment and accessories

The present research involved the use of 50 l spiratron loaded with 50 kg chips of ceramically bound corundum powder. The grinding tests were conducted with articles of hardened steel that had a martensitic structure.

The grinding results were followed up by a Surtronic 10 roughness meter.

The residual roughness RR was measured, and from this the residual roughness in terms of percentage (%RR) was calculated, i.e. the roughness of a metal surface after an grinding test in percentages of the roughness that said metal surface has prior to grinding. This implies: the lower the %RR value, the more favourable the grinding result,

FIGURES

The results of the tests described hereafter are shown in diagrams.

Figure 4:
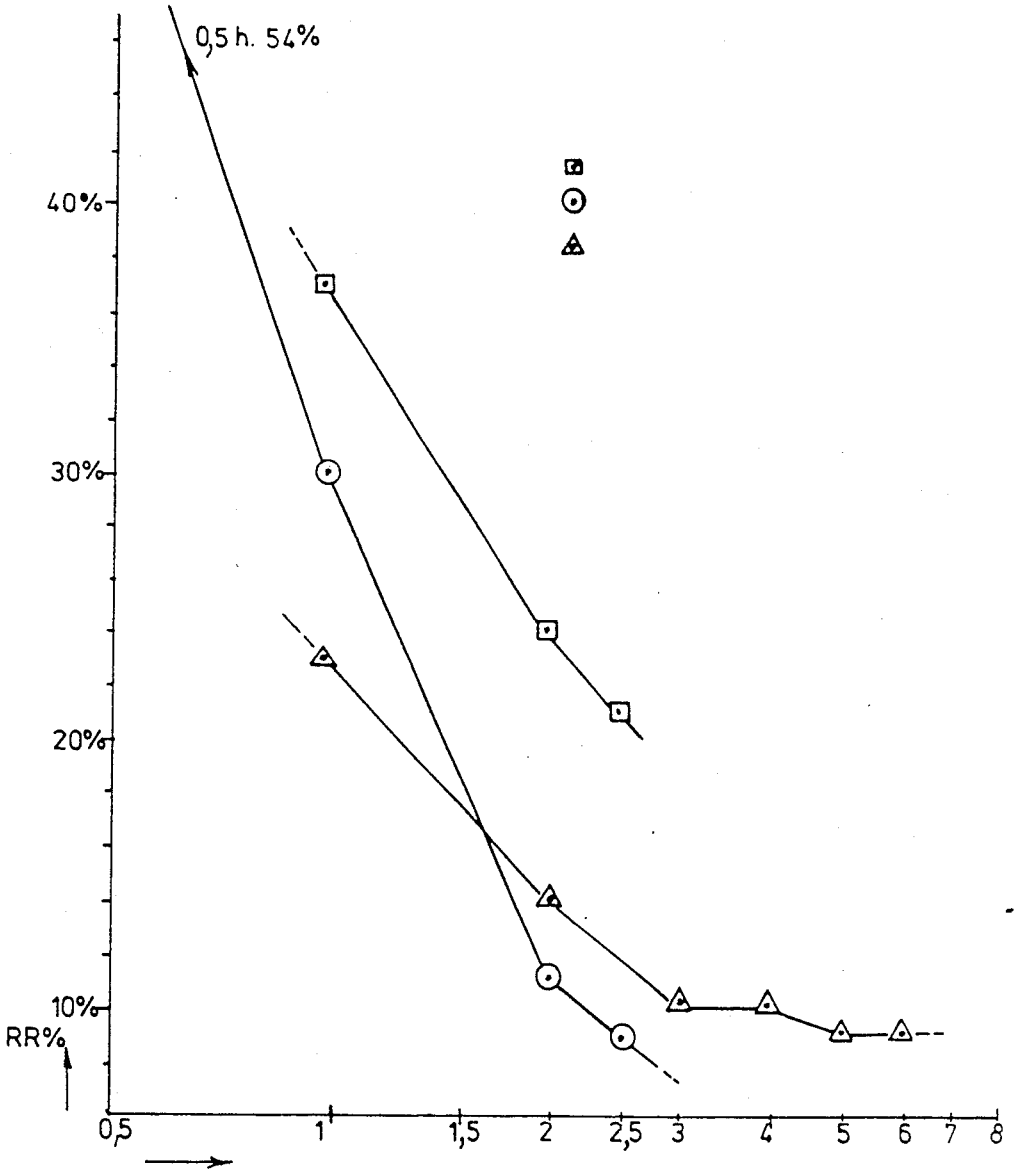

FIG. 4. represents the percentage of residual roughness as a function of the grinding period for several compounds.

Use of acids as grinding-period-reducing compound

Elaborating on the work of Semenek et al, tests were conducted with aqueous solutions of oxalic acid (the organic acid mostly applied in metal treatment, since it is a strong acid and hardly leads to corrosion problems) as the compound.

The influence of the temperature and the oxalic acid concentration on the grinding and polishing action were measured. The test results relating the influence of oxalic acid concentration were all included in diagram 1. The %RR value diminishes when the acid concentration is increased. However, it is surprising that a dip occurs in the curve at a concentration of about 4.5 weight % oxalic acid.

This implies that in the given conditions, the best grinding results are to be expected at lower acid concentrations with a solution of about 4.5 weight % oxalic acid.

Similar results were obtained with other acids mentioned by Semenek et al, at the same pH. Particularly citric acid is an excellent alternative.

The test results relating to the influence of temperature on the grinding process have been combined diagram II.

It appears from the diagram that the temperature is an important factor in the grinding process (reduction of about 1 % RR per degree Celcius). The occurrence of pitting (and other corrosion defects) determines the limits of the temperature increase. The temperature restriction is different for every type of metal and/or alloy and can best be empirically determined for any chosen grinding condition.

Influence of metal powders

In the present research, the reducing aspect of the acid medium was boosted by adding a metal powder.

Any acid medium (pH 7) has a reducing effect by suspending a metal powder in said medium, if the oxidation potential of said metal is positive (and if no oxidating substances are present). If, moreover, the oxidation potential of the suspended metal powder is higher than that of the the metal surface to be treated, positive contact potentials are an important factor in establishing the desired surface hydrogen brittleness.

It has appeared from many tests, that zirconium and zinc powder (with oxidation potentials of 1.5V, 0.8V, respectively) when grinding steel (oxidation potential of about 0.4V) produced % RR values that are far lower than those obtained by molybdenum, tin and tungsten (with oxidation potentials of 0.2, 0.14 and 0.1V, respectively).

Apparently these results coincide with the above-stated hypothesis.

In these experiment, the conditions as used in the experiments after the influence of oxalic acid concentration and temperature, (b), were extended by the addition of extremely finely divided zinc (Zincoli 600 and 620). Zinc powder was chosen for the experiments because this has a favourable oxidation potential, is readily available and inexpensive, but other metals with a higher oxidation potential than the metal to be ground, such as zirconium and aluminum, have similar results.

The influence of the concentration of this zinc powder in the optimum oxalic acid medium on the grinding process was tested (oxalic acid conc. 4.5 %, temperature 35° C.).

Figure 1:
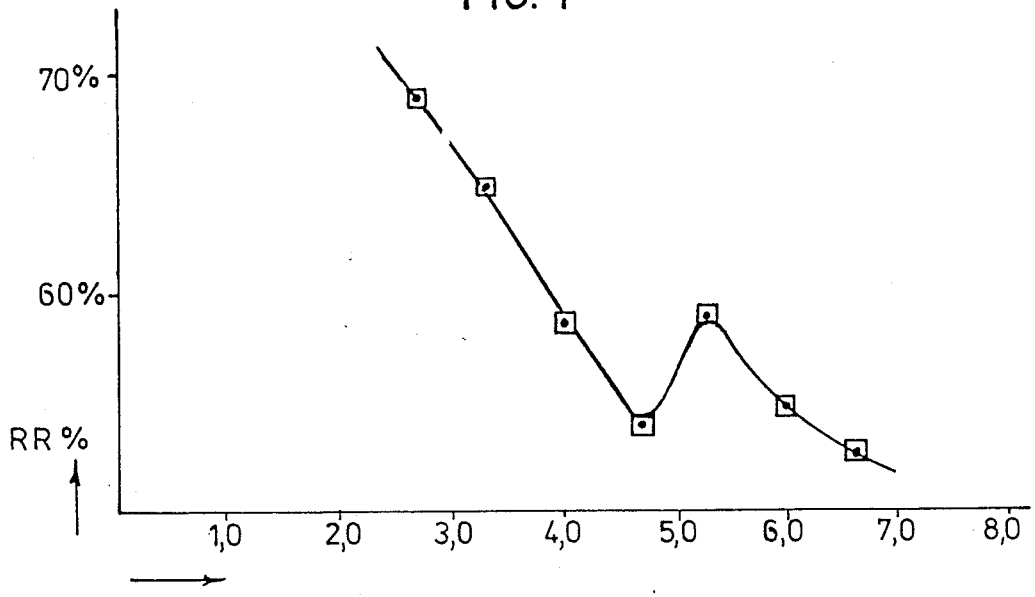
FIG. 1 represents the percentage of residual roughness (%RR) as a function of the oxalic acid concentration. The various tests were all conducted during an equally long period of time.
Figure 3:
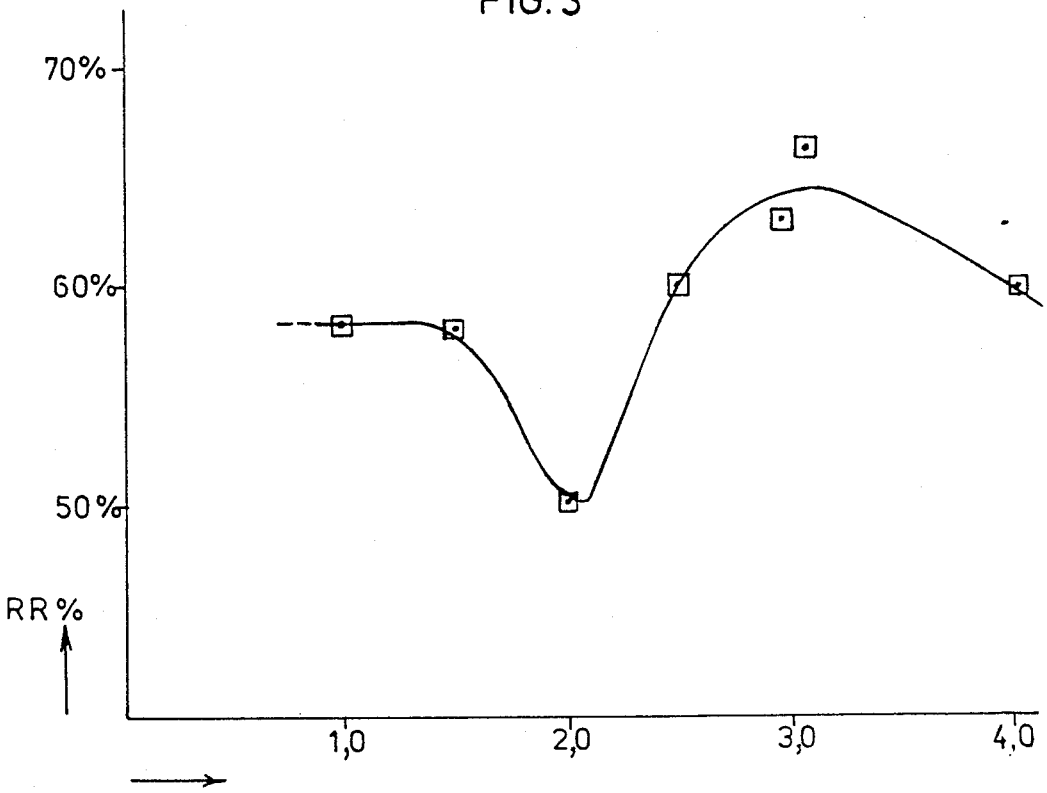
FIG. 3 represents the percentage of residual roughness as a function of the concentration of zinc powder.
Figure 2:
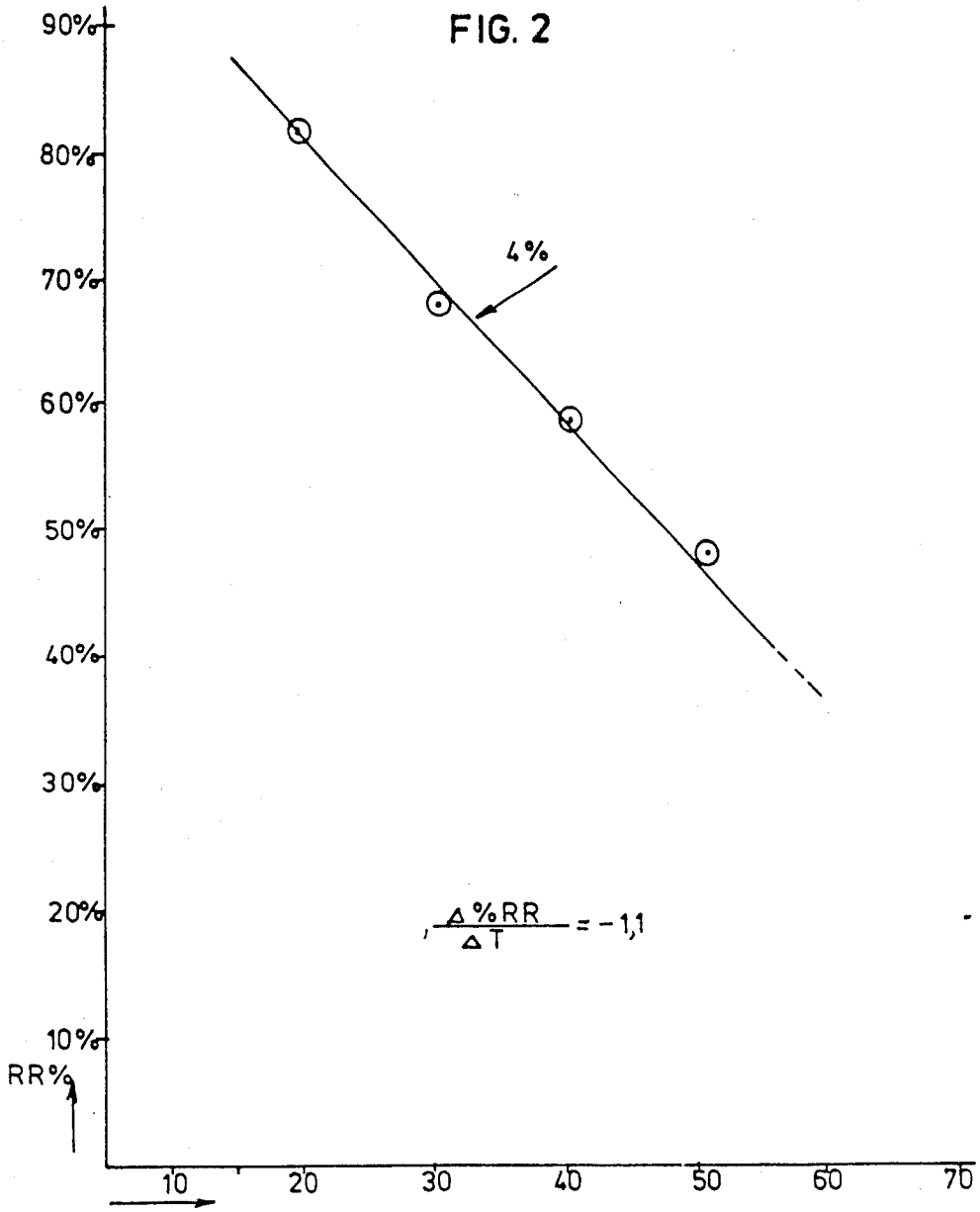
FIG. 2 represents the percentage of residual roughness as a function of the temperature while using 4% oxalic acid.

The results were combined in FIG. 3.

In view of this diagram, the use of a compound that is an organic acid or mixture of organic acids or solution of organic acids in a concentration suitable for grinding and/or polishing the metal articles, while also a finely divided metal or alloy with an oxidation potential greater than zero is present in the grinding/polishing environment, yields a clear improvement of the grinding and/or polishing action, which is attributed to the hydrogen brittleness.

It is surprising that as with the concentration-related curve for oxalic acid, a dip occurs here too in the curve. It can be concluded that at about 0.25 weight % zinc powder the grinding and polishing results are optimal for hardened steel articles.

It goes without saying that a finely divided metal powder can also be introduced into the grinding medium in another manner, e.g.:

a. the metal powder can have been incorporated in adequate quantities in the chips that are to be used, so that by mutual scouring action this metal, e.g. zinc, zirconium, aluminum, is released finely divided so as to boost the aimed hydrogen brittleness.

b. the metal, e.g. zinc, zirconium, aluminum can be added to the grinding process in adequate quantities as such, or as an alloy in the form of e.g. pellets. By mutual scouring action with articles and chips this metal, e.g. zinc, zirconium, aluminum is scoured off and participates in the brittling process as grinding dust.

Influence of particle size

It appeared from grinding experiments with zinc powder, that the particle size of the metal is essential. The best results were obtained with extremely finely divided metal (zinc) powder of a particle size ranging from 0.1 to 10 μm. The reason for this is probably to be found in the increased chemical reactivity of extremely small particle dimensions as shown clearly with nickel derived from nickel carbonyl, which is so finely divided that this nickel is pyrophorus when exposed to air.

In diagram IV the results of the most favourable combination of the present grinding experiments are compared to the grinding results of Michaud as recapitulated in table II of his patent (U.S. Pat. No. 4,491,500). Like the present invention, Michaud's grinding results relate to the grinding of hard metal articles at 35–40° C. is a spiratron. As a compound, Michaud used poly phosphate, oxalic acid and, for the oxidating environment, hydrogen peroxide.

The diagram shows that the present metal-(zinc)containing compound yields better grinding results in a reducing environment that the oxidating compound claimed by Michaud.

As stated before, this research was started on the hypothesis that an acceleration of the grinding and polishing process can be obtained by boosting the development of hydrogen brittleness in the surface of the articles to be treated.

This hydrogen brittles (a physical factor) is apparently the bulk of the contribution towards improvement, i.e. the acceleration of the scourability of the rough metal surface. The oxidatively conditioned chemical conversion layer as claimed by Michaud (U.S. Pat. No. 4,491,500) is of secondary relevance.

An acceleration of the grinding and polishing process can be obtained in a reducing environment.

I claim:

1. Process for grinding and/or polishing metal articles in rotofinish equipment, in which (a) an adjusted quantity of said articles, which have a metal surface roughness that is higher than required for the finish, usually larger than 5 μm in AA (i.e. arithmetic average); are introduced to a rotofinish apparatus and rotated for some time with (b) an adequate quantity of chips suitable for grinding and/or polishing the metal articles to be treated and (c) a compound that promotes grinding and/or polishing comprising one or more organic acids, characterized in that the compound is an organic acid or mixture of organic acids or solutions of organic acids in a concentration suitable for grinding and/or polishing the metal articles, and in that the grinding environment also comprises a finely divided metal or alloy with an oxidation potential greater than zero.

2. Process according to claim 1, characterized in that the organic acid is oxalic acid and/or citric acid having a concentration ranging from 0.5–50.0 %, preferably from 3–6 %, per liter liquid.

3. Process according to claim 1, characterized in that the finely divided metal or alloy of metals has an oxidation potential that is greater than the oxidation potential of the metal or metal alloy of which the articles to be ground or polished are made, by which positive contact potentials cathodically stimulate the development of the desired hydrogen brittleness.

4. Process according to claim 1, characterized in that the extremely finely divided metal is zinc, of a particle size of 0.01–400 μm, preferably from 0.5–20.0 μm.

5. Process according to claim 1, characterized in that the finely divided metal and/or alloy, particularly zinc, zinc powder occurs in the compound and/or chips in a concentration of 0.5–9.5 %, preferably from 0.1–0.8 % per liter compound and/or in that the chips comprise such an amount of metal and/or alloy, particularly zinc, that during the treatment about 0.05–9.5 % per liter, preferably 0.1–0.8 % per liter of the metal or the alloy, particularly zinc, ends up in the grinding environment.

6. Process according to claim 1, characterized in that the extremely finely divided metal powder is obtained in adequate quantities by the scouring working on added coarser pieces of said metal or metal alloy.

7. Process for grinding and/or polishing metal articles according to claim 1, characterized in that the articles have been made of steel, preferably hardened steel.

* * * * *